US005291381A

United States Patent [19]

Price

[11] Patent Number: 5,291,381

[45] Date of Patent: Mar. 1, 1994

[54] LIGHT FIXTURE MOUNTING ASSEMBLY

[76] Inventor: Edison Price, 112 Green St., Brooklyn, N.Y. 11222

[21] Appl. No.: 52,115

[22] Filed: Apr. 23, 1993

[51] Int. Cl.[5] ..... F21S 1/06

[52] U.S. Cl. ..... 362/366; 362/371; 362/427; 248/222.3; 248/291

[58] Field of Search ..... 362/364, 365, 366, 427, 362/418, 396, 398, 372, 371, 287; 248/222.3, 291

[56] References Cited

U.S. PATENT DOCUMENTS

| | | | |
|---|---|---|---|
| 1,882,185 | 10/1932 | Graham | 362/427 |
| 2,655,337 | 10/1953 | Diesfeld | 362/427 |
| 4,410,933 | 10/1983 | Blake et al. | 362/427 |
| 4,489,366 | 12/1984 | Roznieckl | 362/398 |
| 4,903,934 | 2/1990 | Fremstad | 248/222.3 |
| 4,999,758 | 3/1991 | Wimberly | 362/396 |

*Primary Examiner*—James C. Yeung
*Attorney, Agent, or Firm*—Brumbaugh, Graves, Donohue & Raymond

[57] ABSTRACT

A light fixture support member is attached to a cam plate portion of a mounting member having an elongated slot of uniform width by a cam head fastener mechanism that includes a screw having a head portion, a shank portion and a lock portion between the head portion and the shank portion. The shank portion is threaded and passes through the hole in the base portion of the support member. The lock portion is normally received in the slot of the cam plate portion and is of a size and shape such that the screw cannot rotate substantially when the lock portion is received in the slot. The head portion includes opposite shoulders that are engageable with surface portions of the mounting member on opposite sides of the slot in one rotational position of the screw and disengageable from said portions in another rotational position of the screw so that the head can pass through the slot. A knob is threaded onto the shank portion of the screw, a spring is engaged in compression between the base portion and the knob, and a stop is provided on the screw shank on the opposite side of the knob from the spring and limits the movement of the knob along the shank portion in a direction away from the head portion so that the knob cannot be removed from the screw shank.

7 Claims, 4 Drawing Sheets

LIGHT FIXTURE MOUNTING ASSEMBLY

BACKGROUND OF THE INVENTION

In building spaces in which objects and pictures are put on display, such as in exhibit areas of museums, building lobbies, office reception areas and showrooms, it is desirable to use light fixtures that can easily be removed and replaced by different type fixtures and in which the positions of the lights can be adjusted so that the lighting of the articles on display can be optimized when the exhibit is changed. It is also desirable to install the support systems and wiring for light fixtures in both new construction and renovation without installing the fixtures themselves, lest the fixtures be harmed during the stages of the construction or renovation after the support system and wiring are installed. Indeed, it is often advantageous to both install the fixtures and adjust them at the same time. Various lighting systems, such as high hat fixtures and track lighting, are suited to installation of the fixtures separately from the fixture mounting assembly and wiring but they are not always well-suited to some types of displays and to the architectural concepts of the space.

There is a need, for example, for lighting systems that are recessed into a ceiling and in which the fixtures can be easily and quickly removed and replaced and also adjusted to various lighting needs. For example, the same light mounting structure in a ceiling may be called upon to provide object lighting for one display and wall-wash lighting for another. It is known per se to adapt light fixtures to provide different forms of light by changing lamps, lenses, reflectors and shields, but it is sometimes more convenient and occasionally necessary to make the required changes when the fixtures are removed from their mounts. Also, it may be desirable at times to locate multiple mounts on regular spacings on a ceiling or in a slot recessed into a ceiling, and then be able to attach lighting fixtures to the mounts most advantageously located for the lighting requirements of the particular exhibit.

SUMMARY OF THE INVENTION

An object of the present invention is to provide a light fixture mounting system that enables light fixtures to be easily and quickly attached to a mounting structure and to be removed and replaced with equal ease and speed. It is a further object to provide a mounting system that enables the installation, removal and reinstallation to be accomplished without tools by one person. It is, furthermore, desired to minimize the number and complexity of the components of a fixture mounting system by providing for both attachment and adjustment of the fixture by a single fastener mechanism. Moreover, it is another objective to provide a mounting system in which the components are not detached from the fixture (or the mount) and, therefore, cannot fall to the floor when being removed or installed and cannot be misplaced. Yet another objective is to have the fixture remain in whatever position it is adjusted to, and to be able to lock it securely in the adjusted position.

The foregoing objects are attained, in accordance with the present invention, by a light fixture mounting assembly comprising a fixture support member adapted to support the light fixture and including a base portion having a hole, a fixture mounting member adapted to be affixed to a building element and including a cam plate portion having an elongated slot of uniform width, and a cam head fastener mechanism releasably joining the base portion of the support member to the mounting member in a predetermined, adjusted position.

The fastener mechanism includes a screw having a head portion, a shank portion and a lock portion between the head portion and the shank portion. The shank portion is threaded and passes through the hole in the base portion of the support member. The lock portion is normally received in the slot of the cam plate portion and is of a size and shape such that the screw cannot rotate substantially when the lock portion is received in the slot. The head portion includes opposite shoulders that are engageable with surface portions of the mounting member on opposite sides of the slot in one rotational position of the screw and disengageable from said portions in another rotational position of the screw so that the head can pass through the slot. A knob is threaded onto the shank portion of the screw. Preferably, a spring is engaged in compression between the base portion and the knob, and a stop element, such as a lock nut, an upset thread, a cap or the like, is provided on the screw shank on the opposite side of the knob from the spring and limits the movement of the knob along the shank portion in a direction away from the head portion.

In the installed condition of the cam head fastener mechanism, the knob is threaded firmly toward the head and clamps the base portion of the support member against the cam plate. To release the mechanism, the knob is rotated by hand to unthread it until it stops against the stop nut. The knob and screw are then pushed toward the cam plate, which disengages the lock portion from the slot in the cam plate, and then rotated so as to align the shoulders of the screw head with the slot. The screw can then be pulled out through the slot in the cam plate, which releases the support member and the fixture completely from the mounting member. (Prior to detaching the fixture, a plug that connects it to an electrical receptacle built into the mounting system, is disconnected.) The fastener mechanism stays attached in the hole on the base portion of the mounting member and is ready for reinstallation at all times.

To install the fixture, it is held with one hand in a position in which the base portion of the support member is face to face adjacent the cam plate and so that the head of the cam screw can pass through the slot in the cam plate. The knob is gripped by the other hand and pushed against the bias of the spring to move the screw through the slot in the cam plate far enough so that the lock portion lies behind the cam plate and is then rotated 90° to position the shoulders for engagement with the cam plate. When the knob is released, the spring pulls the screw back to engage the lock portion of the screw with the walls of the slot and the shoulders of the screw head with the back of the cam plate. The knob is threaded toward the screw head portion to loosely clamp the base portion of the support member against the cam plate, the fixture is moved relative to the cam plate to the desired orientation, the fastener mechanism moving along the slot accordingly, and the knob fully tightened to firmly clamp the support member to the mounting member. As the knob is being rotated toward the installed position, the lock portion of the screw prevents the screw from rotating. During the tightening of the knob, the spring holds the lock portion engaged in the slot of the cam plate. Once the screw has been turned to engage the shoulders of the head portion with the cam plate, the fixture can be released, and its weight will aid in keeping the lock portion engaged by pivoting the support member away from the cam plate as the knob is threaded along the screw in the tightening direction.

In a preferred embodiment, the head portion of the screw has surfaces tapering toward each other and in a direction away from the shank portion so as to facilitate inserting the head portion through the slot in the cam plate when installing the fixture support member on the mounting member. The tapered surfaces provide a camming action that tends to turn the head to a position in which the head can pass through the slot in the cam plate.

Advantageously, the knob has a recess facing the stop portion of the screw, and the spring is compressed into the recess when the knob is tightened to clamp the base portion of the support member to the cam plate. In this arrangement, the knob bears directly against the base portion in the installed position.

For a better understanding of the invention, reference may be made to the following description of an exemplary embodiment, taken in conjunction with the accompanying drawings.

DESCRIPTION OF THE EMBODIMENT

Figure 1:
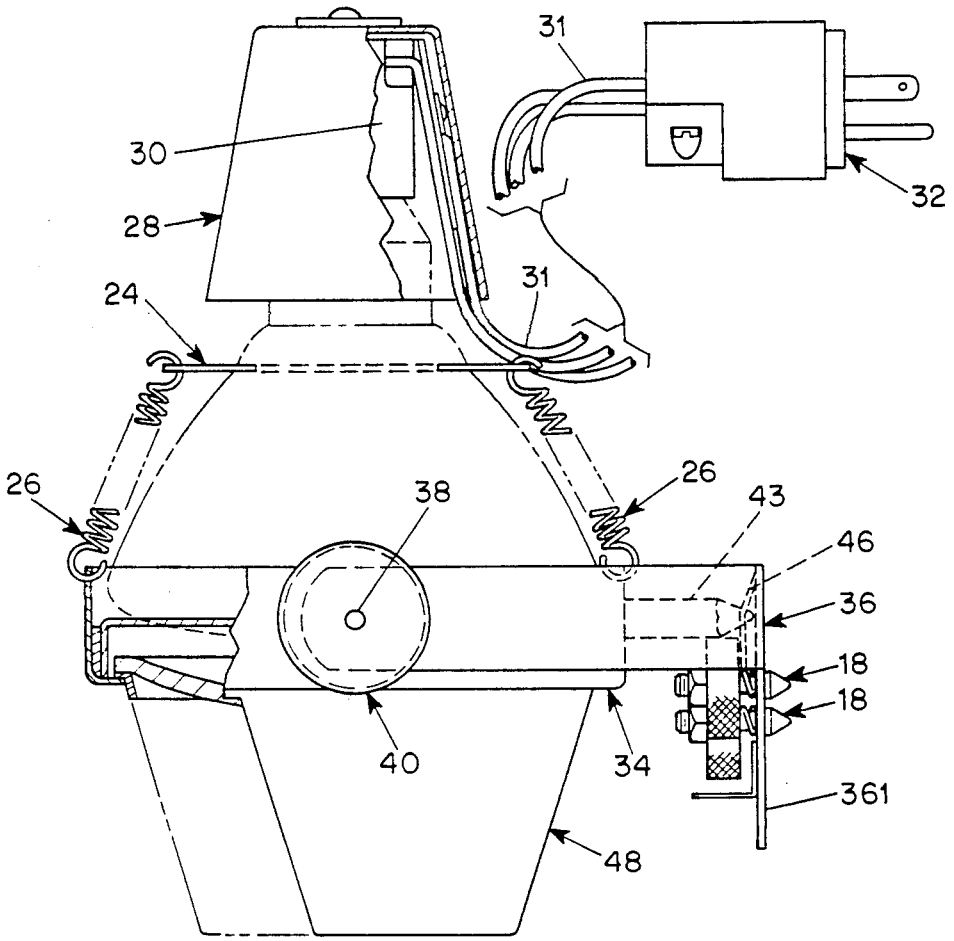
FIG. 1 is front elevational view of a light fixture that is equipped with an embodiment of the mounting assembly.
Figure 2:
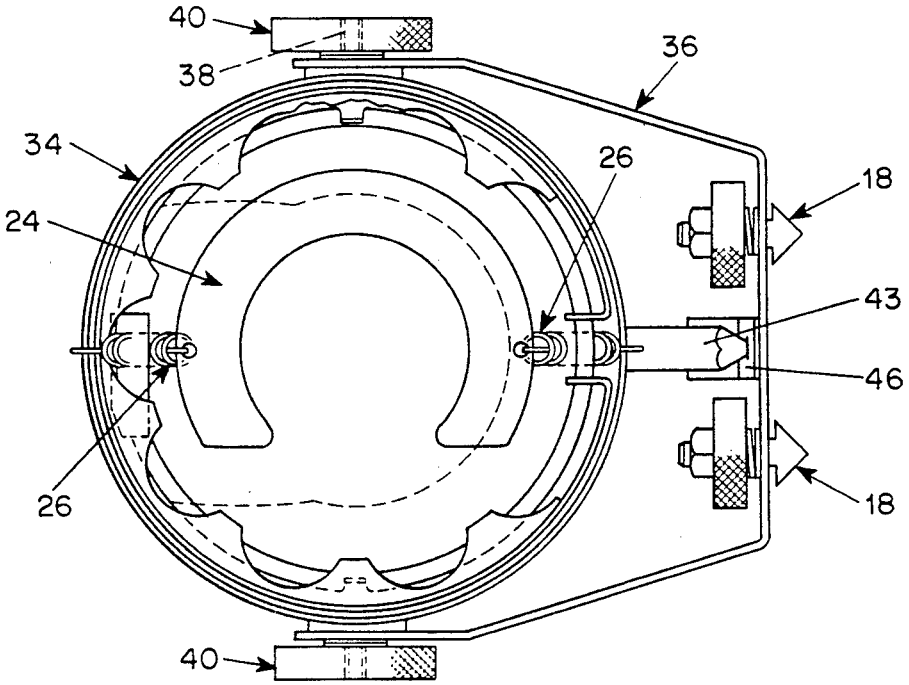
FIG. 2 is a top plan view of the fixture of FIG. 1.
Figure 3:
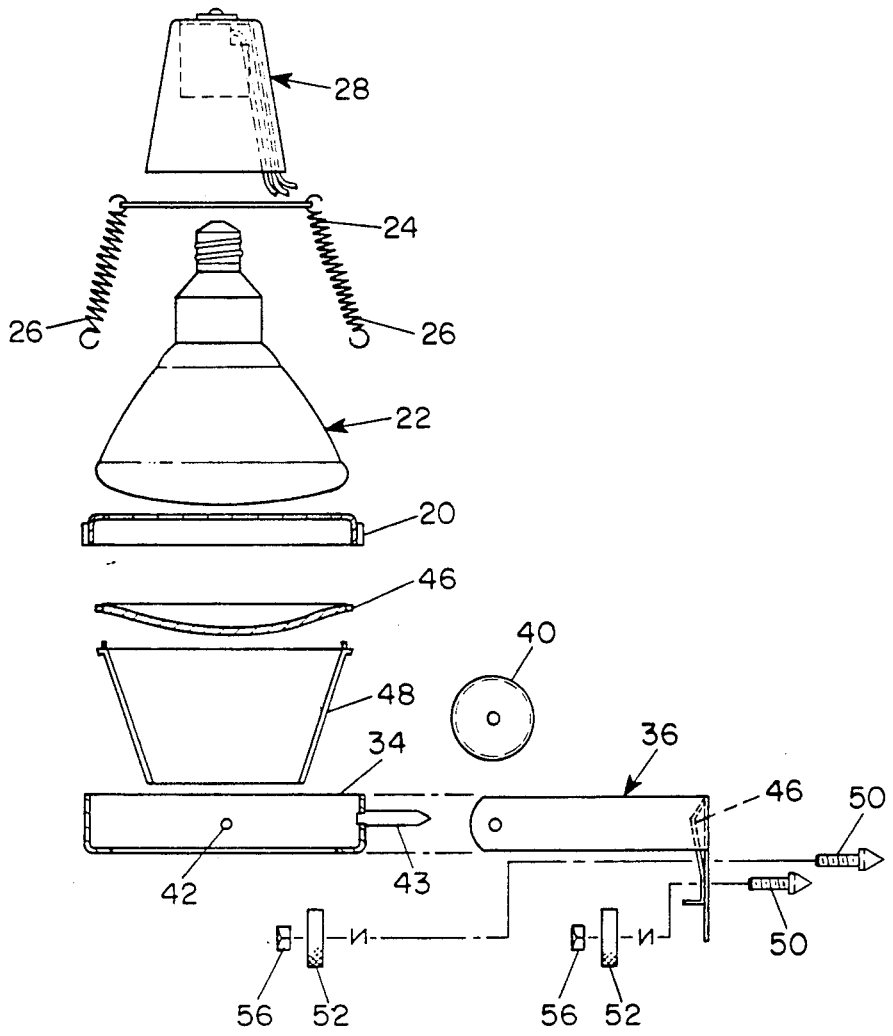
FIG. 3 is an exploded side elevational view of the fixture shown in FIGS. 1 an 2.
Figure 4:
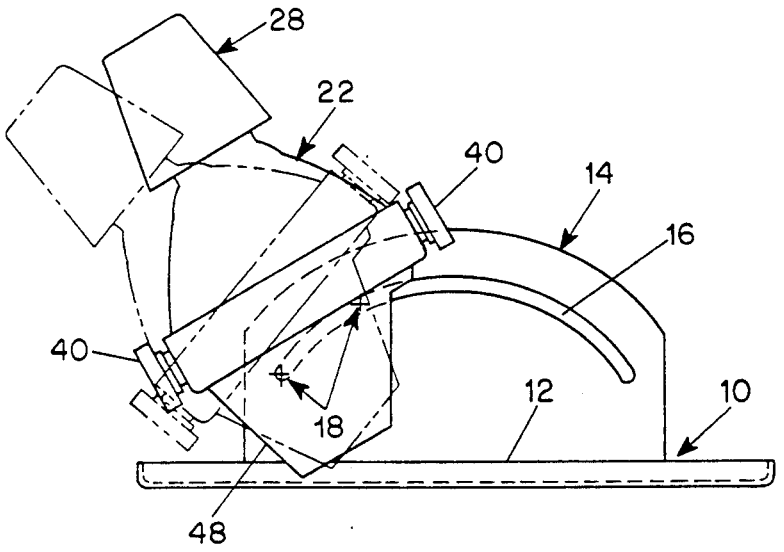
FIG. 4 is side elevational view, in simplified form of the fixture of FIG. 1 to 3, that illustrates adjustment of the mounting assembly.

The light fixture shown in FIGS. 1 to 4 is merely exemplary of fixtures that can be attached at any mounting location using the mounting assembly of the present invention. Commonly, such fixtures are mounted in a recess in a ceiling on a mounting member that can be of various forms. In the simplest form, as shown in FIG. 4, the mounting member 10 includes a base plate portion 12, which is received between and suitably attached to a pair of T-bars of a suspended ceiling system (not shown) and has a hole through which the light from the fixture passes, and a cam plate portion 14, which extends orthogonally upwardly from the base plate portion and has a slot 16 for reception of fastener assemblies 18 (indicated by "X" in FIG. 4) by which the fixture support member is attached to the mounting member.

The fixture itself (FIGS. 1 to 3) includes an annular lamp-holding ring 20, a lamp 22 that nests in the lamp-holding ring and is held in place by a C-shaped retaining ring 24 and springs 26 that pull the retaining ring toward the lamp-holding ring, and a socket holder cup 28, which receives the lamp socket 30. A cable 31 leads from the socket to a plug 32. The lamp-holding ring 20 nests in a mounting ring 34, which is attached to a support member in the form of yoke 36 by screws 38 that are affixed to knurled knobs 40 and that thread into holes 42 located at diametrically opposite points on the ring 34. When the knobs 40 are tightened, the mounting ring is clamped in place on the yoke, usually in a position established by reception of the tip of a pin 43 in a hole in an indexing leaf spring 44 attached to the yoke 36. The mounting ring may, however, be clamped to the yoke in any desired position. The mounting of the mounting ring on the yoke so that it can pivot relative to the yoke is intended mainly to permit changing the lamp, which is facilitated by loosening the knobs, releasing the pin, and inverting the fixture. The lamp retaining ring 24 is then pulled toward the socket and sideways to disengage it from the lamp 22. The release of the lamp and the socket cup to which the lamp is connected permits the lamp to be removed from the socket and replaced by a new one or a lamp with a different photometric distribution.

The fixture also has a lens 46, which can, of course, be of any of various known types, and a shield cone 48, the design of which may also be varied. In the example shown in the drawings, the lens 46 is a spread lens and the cone 48 is open along one side and has a reflective surface opposite the opening, so that the light is spread sideways and directed laterally for wall-wash lighting. The lens and cone shield nest within the mounting ring 34 below the lamp-holding ring 20 and can be turned to direct the light in a desired direction radially of the vertical axis of the fixture.

The fixture is attached to the mounting member 10 by a mounting assembly that permits it to be installed and removed quickly and easily. As may best be seen in FIG. 5, the yoke 36 that supports the fixture has a base portion 361 having a hole 362, and, as described above, the mounting member 10 in the ceiling has a cam plate portion 14 that extends upwardly orthogonally to the base portion 12 and has an elongated slot 16 of uniform width. In the example, the slot is arcuate, but it may be of any desired shape that will enable a desired adjustment in the position and orientation of the fixture to be made. The cam head fastener mechanism 18 releasably joins the base portion 361 of the yoke to the mounting member in a predetermined, adjusted position. Although two such fastener mechanisms 50 are used in the embodiment shown in the drawings, one of the mechanisms can be replaced by a stud on the base portion of the yoke that is received in the slot.

Figure 8:
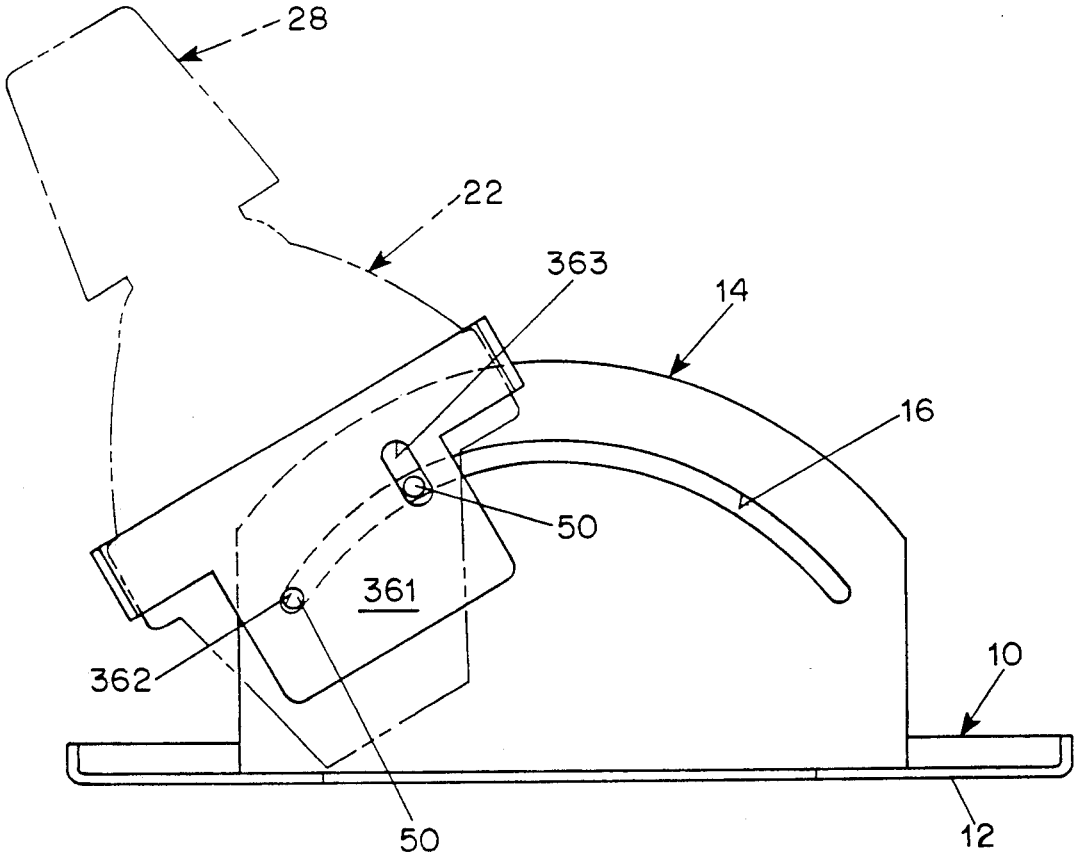
FIG. 8 is a generally schematic view showing an additional adjustment feature that can be included in the mounting system.

In the illustrated embodiment, more particularly, there is a hole 363 (the right one in FIGS. 4 and 8) in the base portion 361 of the yoke 36 that is elongated in a direction transverse to the slot in the cam plate portion of the mounting member. This arrangement permits the fixture to be adjusted both as to its location along the length of the slot 16 and the orientation of its vertical axis, the latter adjustment being shown by the phantom lines in FIG. 4. As is apparent from FIGS. 4 and 8, the elongated hole 363 in the base portion of the yoke allows the tilt of the fixture to be adjusted by pivoting the fixture about the fastener received in the other hole 362 in the base portion of the yoke. When the two fasteners are tightened, the fixture is held in a desired location along the cam plate at a desired orientation of the fixture axis.

Each fastener mechanism 18 includes a screw 50 having a head portion 50*a*, a shank portion 50*b* and a lock portion 50c between the head portion and the shank portion. The shank portion is threaded and passes through the hole 362 in the base portion 361 of the yoke 36. The lock portion 50c is normally received in the slot 16 of the cam plate portion 14 and is of a size and shape such that the screw cannot rotate substantially when the lock portion is received in the slot. The head portion 50a includes opposite shoulders 50a1 and 5Oa2 that are engageable with surface portions of the cam plate portion 14 of the mounting member 10 on opposite sides of the slot 16 in one rotational position of the screw 50 and disengageable from those portions in another rotational position, preferably 90° from the engaged position, of the screw so that the head portion 50a can pass through the slot. A knob 52 is threaded onto the shank portion 50b of the screw, a spring 54 is engaged in compression between the base portion and the knob, and a lock nut 56 is affixed, such as by a thread-lock adhesive, on the screw shank on the opposite side of the knob from the spring and limits the movement of the knob along the shank portion in a direction away from the head portion. The lock nut, which is a stop for the knob 52, can be replaced by a knob, a pin, a cap pressed onto the end of the screw, a lock ring or upset threads on the screw. The spring, when compressed by tightening the knob, is received entirely within a recess 521 in the knob 52 so that the knob 62 bears directly against the base portion in the installed position of the mechanism, i.e., when the knob is tightened to clamp the base portion of the yoke to the cam plate.

Figures 5, 6:
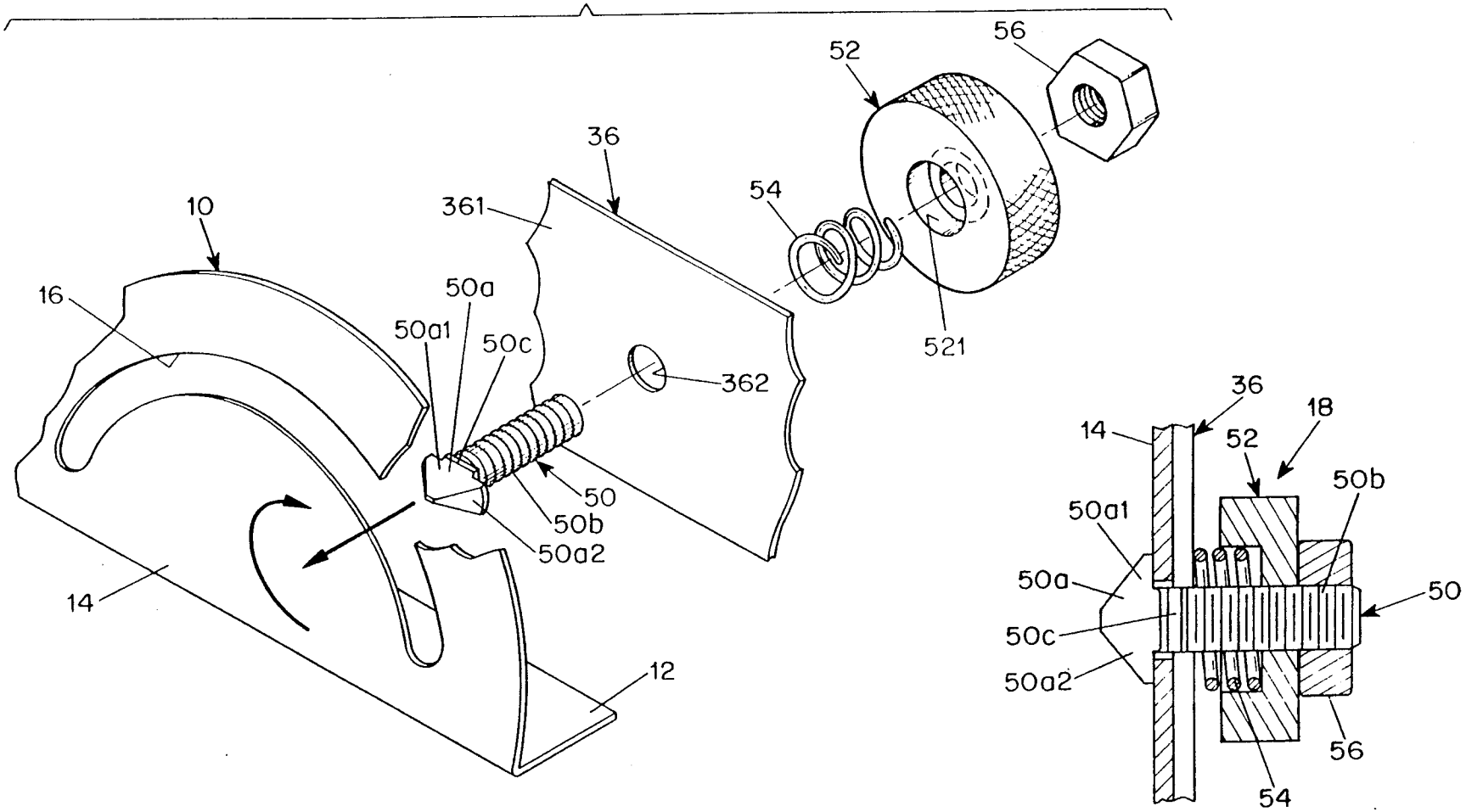
FIG. 5 is an exploded pictorial view of the fastener mechanism of the fixture of FIG. 1 to 4.
FIG. 6 is a fragmentary cross-sectional view of the fastener mechanism.
Figure 7:
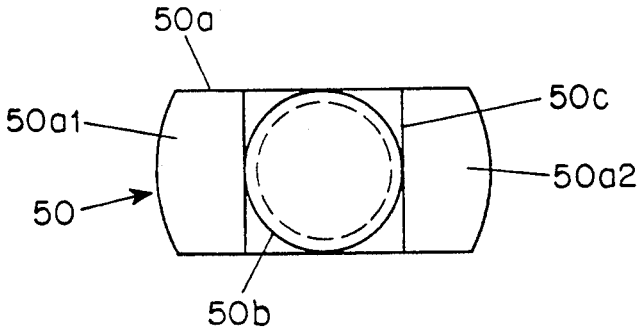
FIG. 7 is an end elevational view of the cam screw of the fastener mechanism.

In the installed condition of the cam head fastener mechanism, the knob 56 is threaded firmly toward the head portion 50a and clamps the base portion 361 of the yoke against the cam plate 14. To release the mechanism, the knob 52 is rotated by hand to unthread it until it stops against the stop nut 56, as shown in FIG. 6. The knob and screw are then pushed toward the cam plate (to the left in FIG. 6) against the force of the spring 54, which disengages the lock portion 50b from the slot 16 in the cam plate, and then rotated 90° more in the same direction so as to align the shoulders 50a1 and 50a2 of the screw head with the slot. The screw can then be pulled out through the slot in the cam plate, which releases the yoke and the fixture completely from the mounting member. (Prior to detaching the fixture, the plug 32 that connects it to an electrical receptacle built into the mounting system, is disconnected.) The fastener mechanism stays attached in the hole on the base portion of the mounting member and is ready for reinstallation at all times.

To install the fixture, it is held with one hand in a position in which the base portion 361 of the yoke 36 is face to face adjacent the cam plate 14 and so that the head of the cam screw can pass through the slot in the cam plate. The knob 52 is gripped by the other hand and pushed against the bias of the spring 54 to move the screw head 50a through the slot in the cam plate far enough so that the lock portion 50c lies behind the cam plate and is then rotated 90° to position the shoulders 50a1 and 50a2 for engagement with the cam plate. When the knob is released, the spring pulls the screw back to engage the lock portion of the screw with the walls of the slot and the shoulders of the screw head with the back of the cam plate. The knob is threaded toward the screw head portion to loosely clamp the base portion of the support member against the cam plate, the fixture is moved relative to the cam plate to the desired orientation, the fastener mechanism moving along the slot accordingly, and the knob fully tightened to firmly clamp the support member to the mounting member. As the knob is being rotated toward the installed position, the lock portion 50c of the screw prevents the screw from rotating. During the tightening of the knob, the spring holds the lock portion engaged in the slot of the cam plate. Once the screw has been turned 90° to engage the shoulders of the head portion with the cam plate, the fixture can be released, and its weight will aid in keeping the lock portion engaged by pivoting the support member away from the cam plate as the knob is threaded along the screw in the tightening direction.

As a preferred but optional feature, the head portion 50a of the screw 50 has surfaces tapering toward each other and in a direction away from the shank portion 50b so as to facilitate inserting the head portion through the slot in the cam plate when installing the fixture support member on the mounting member. The tapered surfaces provide a camming action that tends to turn the screw so that the head is in a position in which it can pass through the slot in the cam plate.

I claim:

1. A light fixture mounting assembly comprising a fixture support member adapted to support the light fixture and including a base portion having a hole, a fixture mounting member including a cam plate portion having an elongated slot of uniform width, and a cam head fastener mechanism releasably joining the base portion of the fixture support member to the mounting member in a predetermined position, the fastener mechanism including a screw having a head portion, a shank portion and a lock portion between the head portion and the shank portion, the shank portion being threaded and passing through the hole in the base portion of the support member, the lock portion normally being received in the slot of the cam plate portion and being of a size and shape such that the screw cannot rotate substantially when the lock portion is received in the slot, and the head portion including opposite shoulders engageable with surface portions of the mounting member on opposite sides of the slot in one rotational position of the screw and disengageable from said portions in another rotational position of the screw so that the head can pass through the slot, and a knob threaded onto the shank portion of the screw.

2. A light fixture mounting assembly according to claim 1 wherein the fastener further includes a spring engaged in compression between the base portion and the knob.

3. A light fixture mounting assembly according to claim 1 wherein the fastener further includes a stop affixed on the screw shank on the opposite side of the knob from the spring and limiting the movement of the knob along the shank portion in a direction away from the head portion.

4. A light fixture mounting assembly according to claim 1 wherein the head portion of the screw has surfaces tapering toward each other and in a direction away from the shank portion so as to facilitate by a camming action inserting the head portion through the slot in the cam plate when installing the fixture support member on the mounting member.

5. A light fixture mounting assembly according to claim 2 wherein the fastener further includes a stop affixed on the screw shank on the opposite side of the knob from the spring and limiting the movement of the knob along the shank portion in a direction away from the head portion.

6. A light fixture mounting assembly according to claim 2 wherein the knob has a recess facing the stop portion of the screw and the spring is received entirely within the recess when the screw is tightened to clamp the base portion of the support member to the cam plate.

7. A light fixture mounting assembly according to claim 1 wherein the base portion of the fixture support member has two holes, one of which is elongated in a direction transverse to the slot in the cam plate, and there is a fastener mechanism received in both of the holes in the base portion and in the slot in the cam plate portion.

* * * * *